US012276052B2

(12) United States Patent
Ping

(10) Patent No.: US 12,276,052 B2
(45) Date of Patent: Apr. 15, 2025

(54) TENSIONING DEVICE

(71) Applicant: NIKE, Inc., Beaverton, OR (US)

(72) Inventor: Hsieh Wei Ping, Douliou (TW)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/083,769

(22) Filed: Dec. 19, 2022

(65) Prior Publication Data

US 2023/0193532 A1 Jun. 22, 2023

Related U.S. Application Data

(60) Provisional application No. 63/292,648, filed on Dec. 22, 2021.

(51) Int. Cl.

| | |
|---|---|
| ***D04B 35/02*** | (2006.01) |
| ***D04B 15/44*** | (2006.01) |
| ***D04B 27/12*** | (2006.01) |
| ***D04B 39/00*** | (2006.01) |

(52) U.S. Cl.

CPC ..... *D04B 35/02* (2013.01); *D04B 15/44* (2013.01); *D04B 27/12* (2013.01); *D04B 39/00* (2013.01)

(58) Field of Classification Search

CPC ..... D04B 15/44; D04B 15/54; D04B 27/12; D04B 27/14; D04B 27/18; D04B 27/20; D04B 27/22; B65H 59/06; B65H 59/10; B65H 59/12; B65H 59/18; B65H 59/20; B65H 59/22; B65H 59/26

See application file for complete search history.

(56) References Cited

U.S. PATENT DOCUMENTS

| | | | | |
|---|---|---|---|---|
| 3,746,226 | A * | 7/1973 | Leclercq | B65H 51/30 226/25 |
| 3,878,697 | A | 4/1975 | Tsunekawa | |
| 3,912,184 | A | 10/1975 | Bous | |
| 3,950,966 | A | 4/1976 | Di Carlo | |
| 4,026,127 | A | 5/1977 | Mccreary et al. | |
| 4,192,158 | A | 3/1980 | Kohl | |

(Continued)

FOREIGN PATENT DOCUMENTS

| | | | |
|---|---|---|---|
| CN | 102041621 | A * | 5/2011 |
| CN | 208362614 | U | 1/2019 |

(Continued)

OTHER PUBLICATIONS

Knitting Machine Features, Shima Seiki, Available online at <https://www.shimaseiki.com/product/knit/feature/>, Jul. 19, 2021, 10 pages.

(Continued)

*Primary Examiner* — Aiying Zhao

(74) *Attorney, Agent, or Firm* — Shook, Hardy & Bacon L.L.P.

(57) ABSTRACT

Aspects herein are directed to a tensioning device for a strand on a knitting machine. The tensioning device includes a mounting plate that may be positioned between a strand source and a feeder bar. The mounting plate supports a first pulley, a second pulley and a weighted third pulley that is movable with respect to the first pulley and the second pulley. By routing a strand over the first pulley, under the third pulley and over the second pulley, additional tension may be added to the strand through the weight of the third pulley.

12 Claims, 6 Drawing Sheets

(56) References Cited

U.S. PATENT DOCUMENTS

| | | | | |
|---|---|---|---|---|
| 4,209,881 | A | 7/1980 | Blore | |
| 4,235,083 | A | 11/1980 | Dale et al. | |
| 4,687,150 | A | 8/1987 | Gutschmit | |
| 4,706,476 | A | 11/1987 | Memminger et al. | |
| 4,829,790 | A | 5/1989 | Memminger et al. | |
| 4,915,323 | A | 4/1990 | Shelton | |
| 5,931,023 | A * | 8/1999 | Brach | D04B 15/80 66/146 |
| 6,467,511 | B2 | 10/2002 | Sollars | |
| 6,637,693 | B1 | 10/2003 | Kaufmann et al. | |
| 8,356,765 | B2 | 1/2013 | Zenoni et al. | |
| 9,481,953 | B2 | 11/2016 | Huffa | |
| 2006/0225465 | A1 * | 10/2006 | Kinder | D04B 23/12 242/564.4 |
| 2007/0227197 | A1 | 10/2007 | Corsani | |

FOREIGN PATENT DOCUMENTS

| | | | | |
|---|---|---|---|---|
| CN | 110438644 | A * | 11/2019 | |
| CN | 212222014 | U * | 12/2020 | |
| CN | 213357898 | U * | 6/2021 | |
| EP | 0481803 | A1 | 4/1992 | |
| EP | 2431511 | A1 * | 3/2012 | D04B 15/48 |
| KR | 100948509 | B1 * | 3/2010 | D04B 1/14 |

OTHER PUBLICATIONS

Rolling Feeder, BTSR, Available online at <https://web.archive.org/web/20160201172929/http://www.btsr.com/products/constant-tension-feeders/Rolling%20Feeder>, Feb. 1, 2016, 4 pages.

Shankam Narayana, Vivekp. , "A Novel Method for Dynamic Yarn Tension Measurement and Control in Direct Cabling Process", Fiber and Polymer Science, NC State University, Available online at <https://repository.lib.ncsu.edu/bitstream/handle/1840.16/5780/etd.pdf?sequence=1&isAllowed=y>, Dec. 2005, 122 pages.

* cited by examiner

TENSIONING DEVICE

CROSS-REFERENCE TO RELATED APPLICATION

This application claims priority to U.S. Provisional Application No. 63/292,648 (filed Dec. 22, 2021), entitled Tensioning Device, which is incorporated herein by reference in its entirety.

TECHNICAL FIELD

Aspects herein relate to a tension device for a strand on a knitting machine, a knitting machine with a strand tensioning device and a method of providing side tension to a strand on a knitting machine.

BACKGROUND

Traditional knitting machines, including flat knitting machines, typically have some type of lever arm to provide side tension to an individual strand, as might be needed to take up slack on the strand when the strand is not being fed into the knitting machine. This type of lever arm works reasonably well when lighter weight strands or lower diameter strands are being used. However, the traditional lever arm approach does not work as well on heavier weight strands or larger diameter strands.

BRIEF DESCRIPTION OF THE DRAWINGS

Examples of aspects herein are described in detail below with reference to the attached drawings figures, wherein.

DETAILED DESCRIPTION

Figure 1:
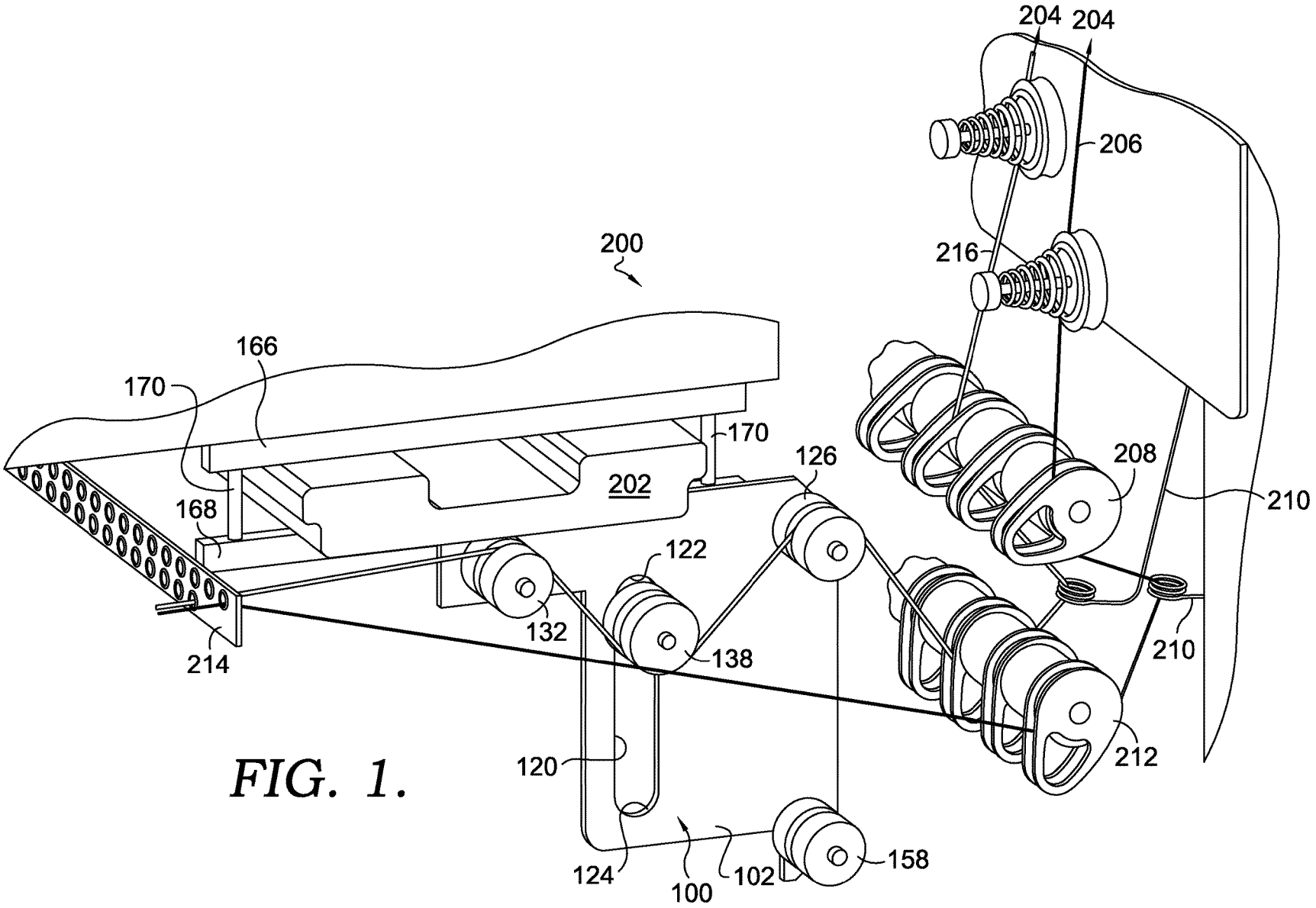
FIG. 1 illustrates a partial perspective view of a knitting machine, with a tensioning device in a un-tensioned state, in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to identify different elements of methods employed, the terms should not be interpreted as implying any particular order among or between various steps herein disclosed unless and except when the order of individual steps is explicitly stated. Unless indicated otherwise, the term "about" or "substantially" with respect to a measurement means within +10% of the indicated value.

Knitting machines are now being used to create portions of garments or portions of footwear, such as footwear uppers. In some constructions, it may be desirable to utilize one or more strands that are of a heavier weight, or larger diameter, than strands that are traditionally used in such constructions. However, the use of these heavier weight or larger diameter strands can create issues in the knitting process and in the finished product.

At a high level, aspects herein are directed to a knitting machine that may include a strand source, a feeder bar, and at least one strand extending from the strand source and through the feeder bar. The knitting machine may further include a tensioning device for the strand that is located between the strand source and the feeder bar. The tensioning device adds tension to the strand when the knitting machine is not actively feeding the strand. As one example, as the feeder for the knitting machine is changing knitting direction, the tensioning device adds tension at the turn-around. This added tension also abates any sudden shock tension to the yarn at the turn-around. This added tension results in tighter loops in the knitted material to produce a better looking garment, with cleaner edges. The tensioning device allows for better knitting results with a wide array of different strand diameters and strand weights, such as, for example, inlaid brio yarns. In another example, the tensioning device improves the "shrink-back" of inlaid Lilly yarns. In example aspects, the tensioning device also includes a mounting arm that is coupled to an upper end of a mounting plate of the tensioning device. The mounting arm couples the tensioning device to a rail on the knitting machine. Aspects herein are also directed to a tensioning device for a strand, where a portion of the strand extends between a feeder bar and a strand source on a knitting machine. The tensioning device includes the mounting plate that has an upper end and a lower end and a first side and a second side that is spaced farther from the feeder bar than the first side. The tensioning device also includes a first pulley coupled to the mounting plate near the upper end and second side of the mounting plate, a second pulley spaced from the first pulley and coupled to the mounting plate near the upper end and first side of the mounting plate, and a third pulley. In some aspects, the third pulley is movably coupled to the mounting plate between the first pulley and the second pulley and is positioned at least partially below the first pulley and the second pulley. This movable coupling of the third pulley to the mounting plate allows the third pulley to move in a direction between the upper end of the mounting plate and the lower end of the mounting plate. The strand is routable over the first pulley, under the third pulley and over the second pulley, where both the weight and movability of the third pulley provide a downward force to increase tension on the strand.

In example aspects, the mounting plate includes a vertical slot having a bottom end near the lower end of the mounting plate and extending to a top end spaced from the bottom end. A first bar extends through the vertical slot on the mounting plate, and the third pulley is coupled to the first bar. In this way, the first bar and the third pulley are vertically moveable with respect to the mounting plate within the vertical slot. The weight of both the bar and third pulley in combination provide a downward force that increases tension on the strand. In example aspects, the first pulley and the second pulley are both rotatably coupled to the mounting plate, and the third pulley is rotatably coupled to the first bar, allowing the strand to move over and/or under each of the pulleys.

In example aspects, the mounting plate also has a front face and a back face. The tensioning device may have a first bearing coupled to the first bar and abutting the front face of the mounting plate and a second bearing coupled to the first bar and abutting the back face of the mounting plate. The first bearing and the second bearing provide controlled movement of the first bar within the vertical slot.

In example aspects, the first bar is removably coupled to the third pulley. The tensioning device may further include other bars having differing weights that are interchangeable with the first bar to allow the tension on the strand to be selectively changed.

In some aspects, the tensioning device may further include a fourth pulley that is coupled to the mounting plate below the first pulley and near the second side of the mounting plate. The fourth pulley may be used, as desired, to increase the tension and/or friction on the strand as it moves through the tensioning device. The strand is then routable under the fourth pulley, over the first pulley, under the third pulley and over the second pulley. In some aspects, the fourth pulley is adjustably coupled to the mounting plate such that the position of the fourth pulley with respect to the mounting plate is adjustable to further adjust the friction experienced by the strand and/or the tension on the strand.

Example aspects of the present disclosure also include a method of providing side tension to a strand on a knitting machine. In aspects, the method may include routing the strand over a first pulley, under a weighted third pulley that is vertically movable with respect to the first pulley, and over a second pulley. A method of providing tension according to some aspects of present disclosure may further include adding an additional weight to the weighted third pulley to increase a tension on the strand. In some aspects, the additional weight added to the weighted third pulley is based on at least one of the weight of the strand or the diameter of the strand. In some aspects, the method may further include, before routing the strand over the first pulley, routing the strand under a fourth pulley to further increase the friction and/or tension on the strand. In still other aspects, the method of providing tension may further include adjusting the spacing between the first pulley and the fourth pulley to provide additional tension to the strand.

Figure 2:
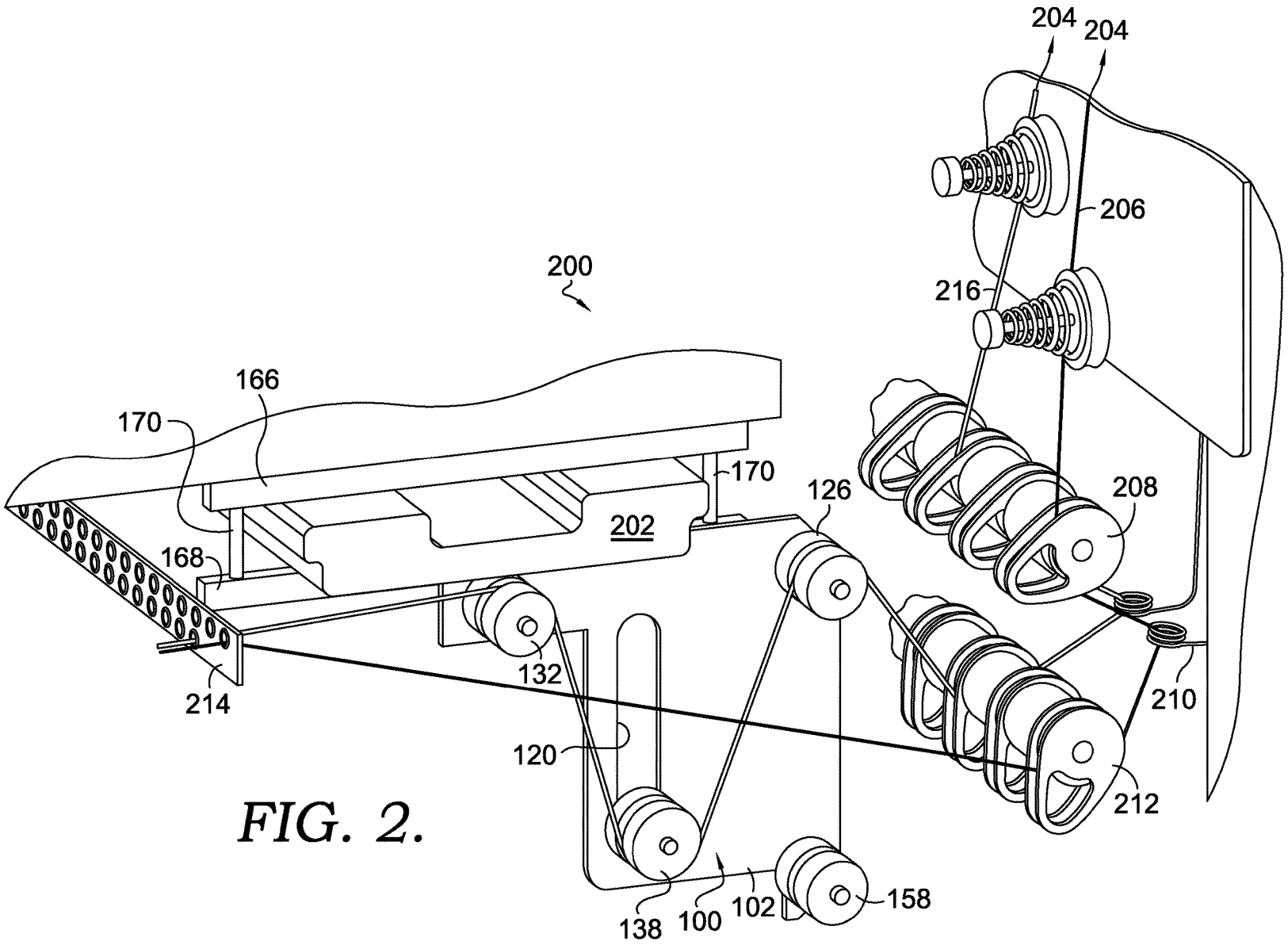
FIG. 2 illustrates a view similar to FIG. 1, but with the tensioning device in a tensioned state, in accordance with aspects herein.
Figure 3:
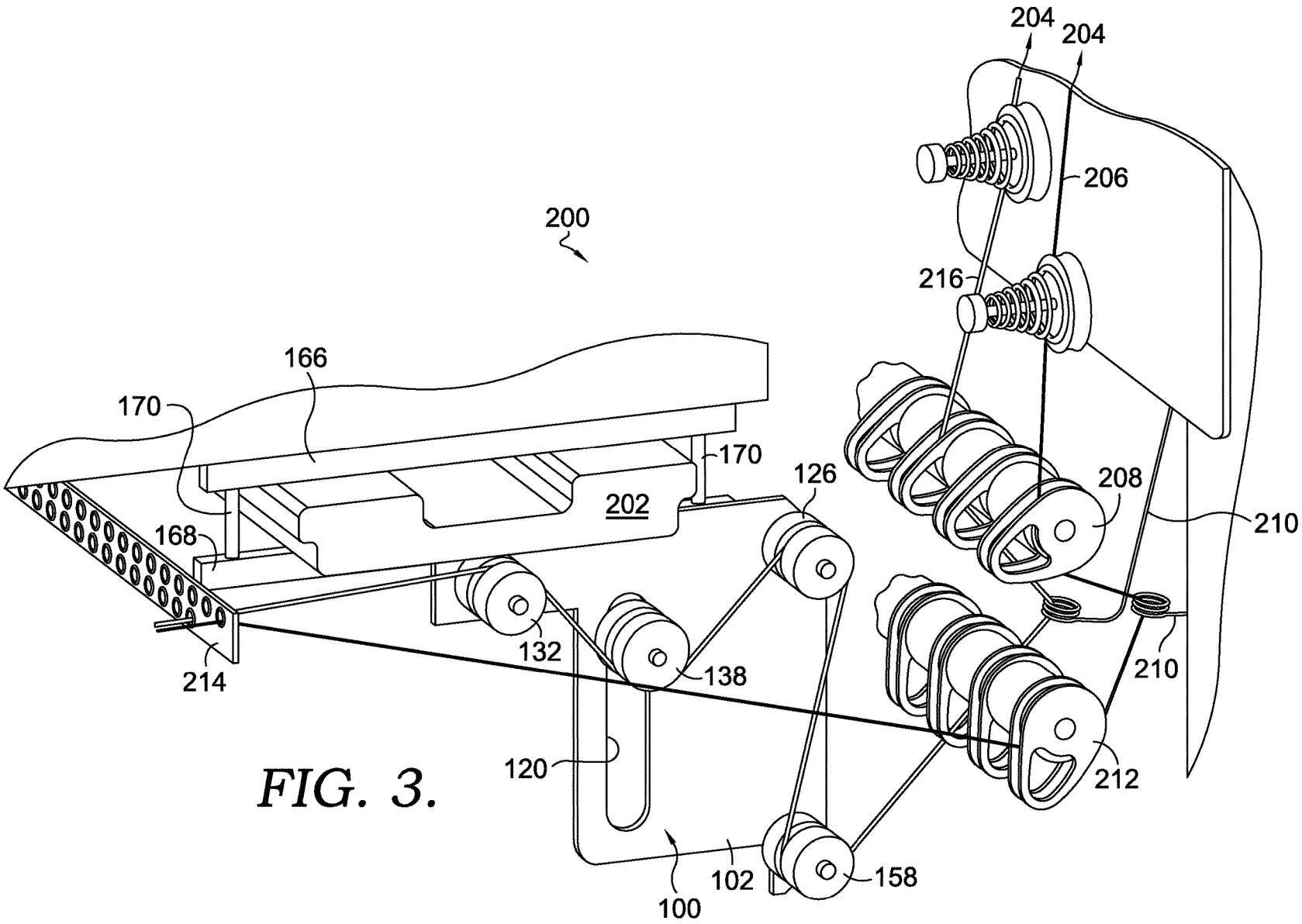
FIG. 3 illustrates a view similar to FIG. 1, showing an alternative routing of a strand through the tensioning device, in accordance with aspects herein.

FIGS. 1-3 show a tensioning device 100 coupled to a knitting machine 200. The knitting machine 200 can be used to knit, such as flat knitting, any type of flat knit garment. In some aspects, the knitting machine 200 can be used to knit an upper for an article of footwear. When used in conjunction with the knitting machine 200, the tensioning device 100 may effectively reduce slack in a strand routed through the knitting machine, thus improving the quality and/or appearance of the resultant knitted fabrics. This may be especially helpful when heavier weight and/or larger diameter strands are used within the knitted fabrics. For simplicity, only portions of the knitting machine 200 are shown. In some aspects, the knitting machine 200 is a flat knitting machine, as shown, having two needle beds that are angled relative to each other (e.g., thereby forming a V-bed) and one or more rails (e.g., rail 202) extending above and along the length of the beds. However, the tensioning device 100 could be used on other types of knitting machines as desired. As shown, the tensioning device 100 is coupled to a rail 202 of the knitting machine 200. The rail 202 extends between an upper member 166 and a lower member 168 of the tensioning device 100. The upper member 166 and the lower member 168 are connected to one another via connectors 170. Knitting machines typically have multiple strands of knitting material (e.g., yarns and fibers made from a variety of natural or synthetic materials, such as cotton, nylon, TPU, polyester, polyurethane, or carbon, etc.) that emanate from a strand source (e.g., a spool, bobbin of yarn, thread, cable, or the like), indicated schematically by arrows 204.

As shown in FIG. 1 a strand 206 is routed around a first guide 208, through a tension arm 210, around a second guide 212 and through a feeder bar 214. The tension arm 210 removes some slack from the strand 206 when it is not being actively fed through the knitting machine 200. In some instances, strands having a heavier weight or larger diameter (e.g., a diameter greater than one millimeter) may not function as desired in this arrangement and removing the slack in these heavier weight or larger diameter strands is not effectively achieved using the tension arm 210 alone. The strand 206 may have the configuration of a multifilament yarn, a filament (e.g., a monofilament yarn), thread, rope, webbing, cable, or chain, for example. In some instances, strands having a heaver weight or larger diameter. In some aspects, the yarn 206 may have a diameter from about 0.1 mm to about 20 mm. The tension device 100 introduces increased tension to the heavier weight and/or larger diameter strand (i.e., shown by strand 216 in FIG. 1), which effectively removes undesired slack, thus improving the quality and/or appearance of the resultant knitted fabrics.

FIG. 1 depicts the strand 216 in a state being actively fed by the knitting machine 200. In this strand-feeding state, the tension arm 210 is in a neutral position (not adding additional tension to the strand 216). In some aspects, the strand 216 is fed, after the guide 212, above a first pulley 126, under a third pulley 138 and over a second pulley 132, before being fed through the feeder bar 214. Additionally, in the strand-feeding state depicted in FIG. 1, the third pulley 138 is pulled, by the tension in the strand 216 caused by the knitting machine 200 feeding the strand 216, to a top end 122 (or near the top end 122) of a vertical slot 120 in a mounting plate 102 of the tensioning device 100.

FIG. 2 depicts the strand 216 in a state where the knitting machine 200 is not actively feeding the strand 216 (a non-feeding state). In this non-feeding state, the tension arm 210 is in an engaged position (adding additional tension to the strand 216) and operates to pull the strand (to the right as viewed in FIG. 2). It has been found that with heavier weight strands, or larger diameter strands, the added tension achieved by the tension arm 210 alone may not effectively remove a desired amount of slack in the strand 216 in this non-feeding state. The tensioning device 100 provides added tension in the strand 216, resulting in a more-desirable knitted construction of the end fabric or product with more evenly sized and evenly tensioned loops. In operation, in the non-feeding state depicted in FIG. 2, the weight of the third pulley 138 adds tension in the strand 216 as gravity pulls the third pulley 138 downwardly within the slot 120. In some aspects, the third pulley 138 may move to a bottom end 124 (or near the bottom end 124) of the slot 120. Additional weight may be added to the third pulley 138, adding additional tension in strand 216 in the non-feeding state. The amount of added tension on the strand 216 can be adjusted as needed to accommodate differing weights and/or diameters of the strand 216, by selecting an appropriately weighted bar that is coupled to the third pulley 138 (such as a first bar 142 or a second bar 154 described below and shown in FIG. 6). While only two bars are depicted, it should be understood that other bars could also be used.

FIG. 3 depicts an alternative routing of the strand 216 through the tensioning device 100. As shown in FIG. 3, to add additional tension and/or friction to the strand 216, the strand 216 may first be routed under a fourth pulley 158 and then routed over the first pulley 126, under the third pulley 138, and over the second pulley 132. In some aspects, the fourth pulley 158 may be movable on the mounting plate 102, such as within a vertical slot or an arcuate slot. Movement of the fourth pulley 158 may place additional tension on the strand 216, such by adding friction. In some aspects, the fourth pulley 158 may be biased to a desired position within a slot on the mounting plate 102, such as with a spring. In some aspects, the strand 216 may not be routed through the tension arm 210, with added tension applied by tensioning device 100.

Figure 4:
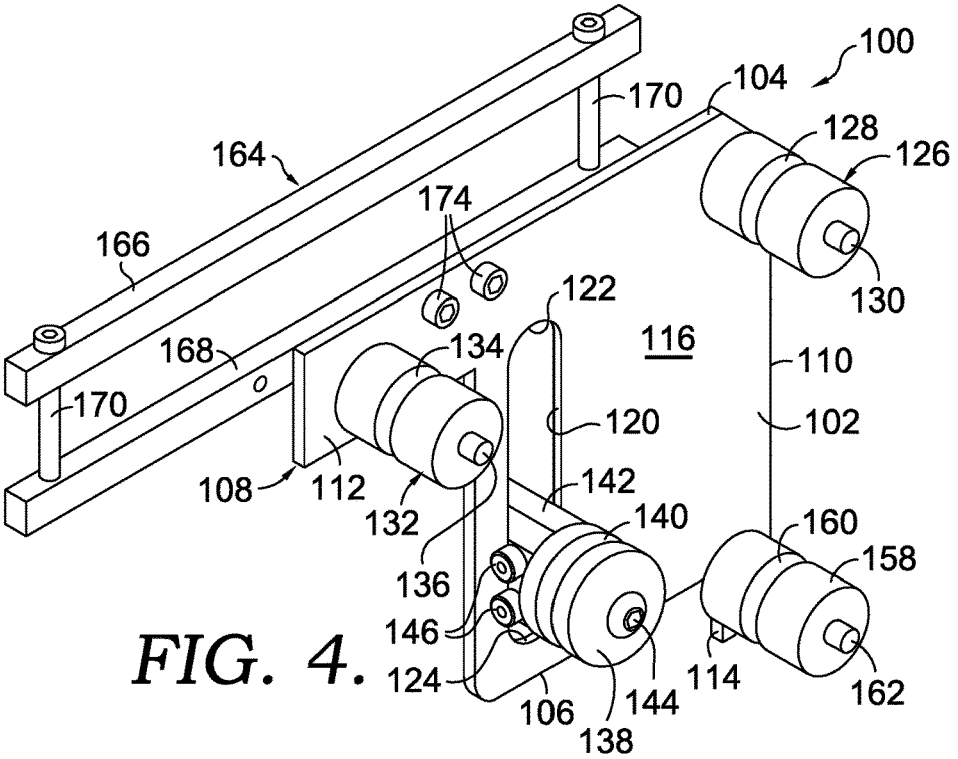
FIG. 4 illustrates a side perspective view of the tensioning device in accordance with aspects herein.
Figure 5:
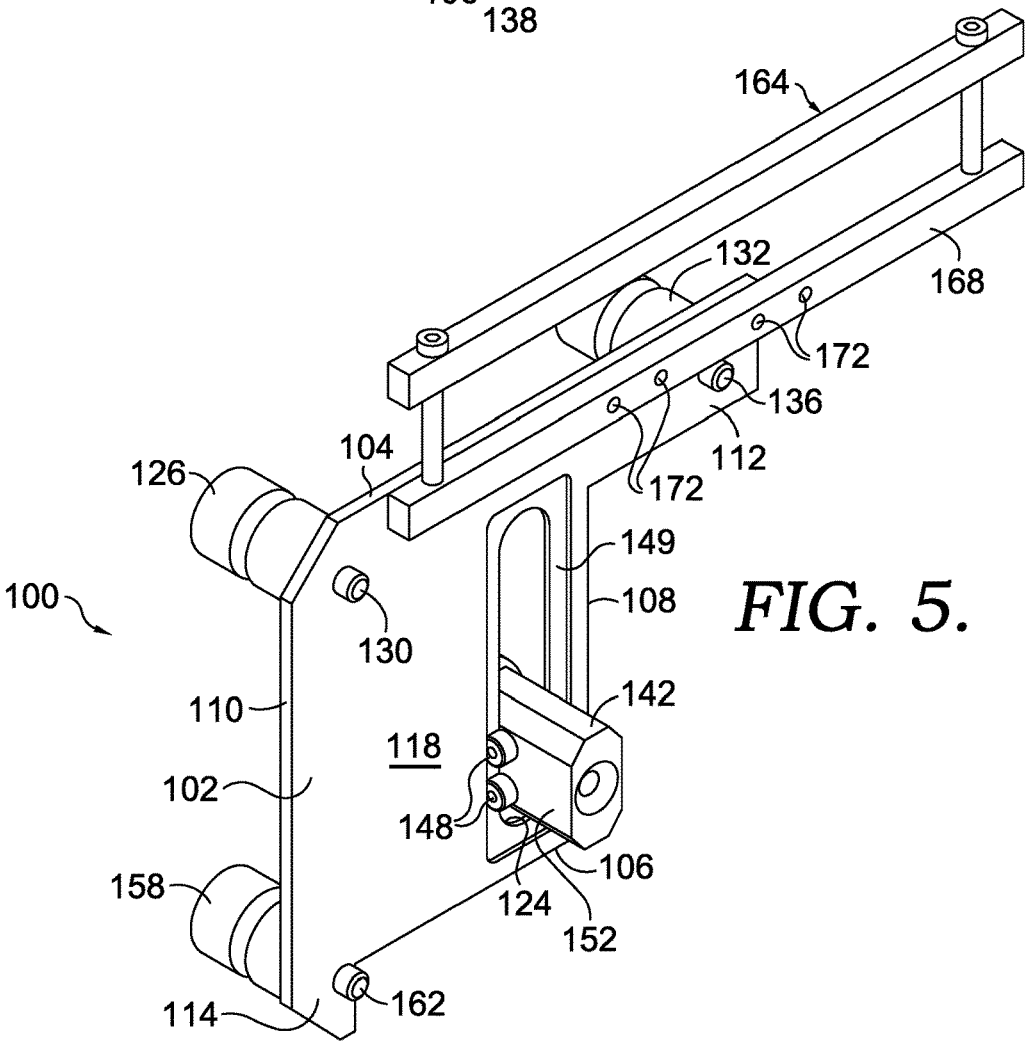
FIG. 5 illustrates an opposite side perspective view of the tensioning device of FIG. 4 in accordance with aspects herein.
Figure 6:
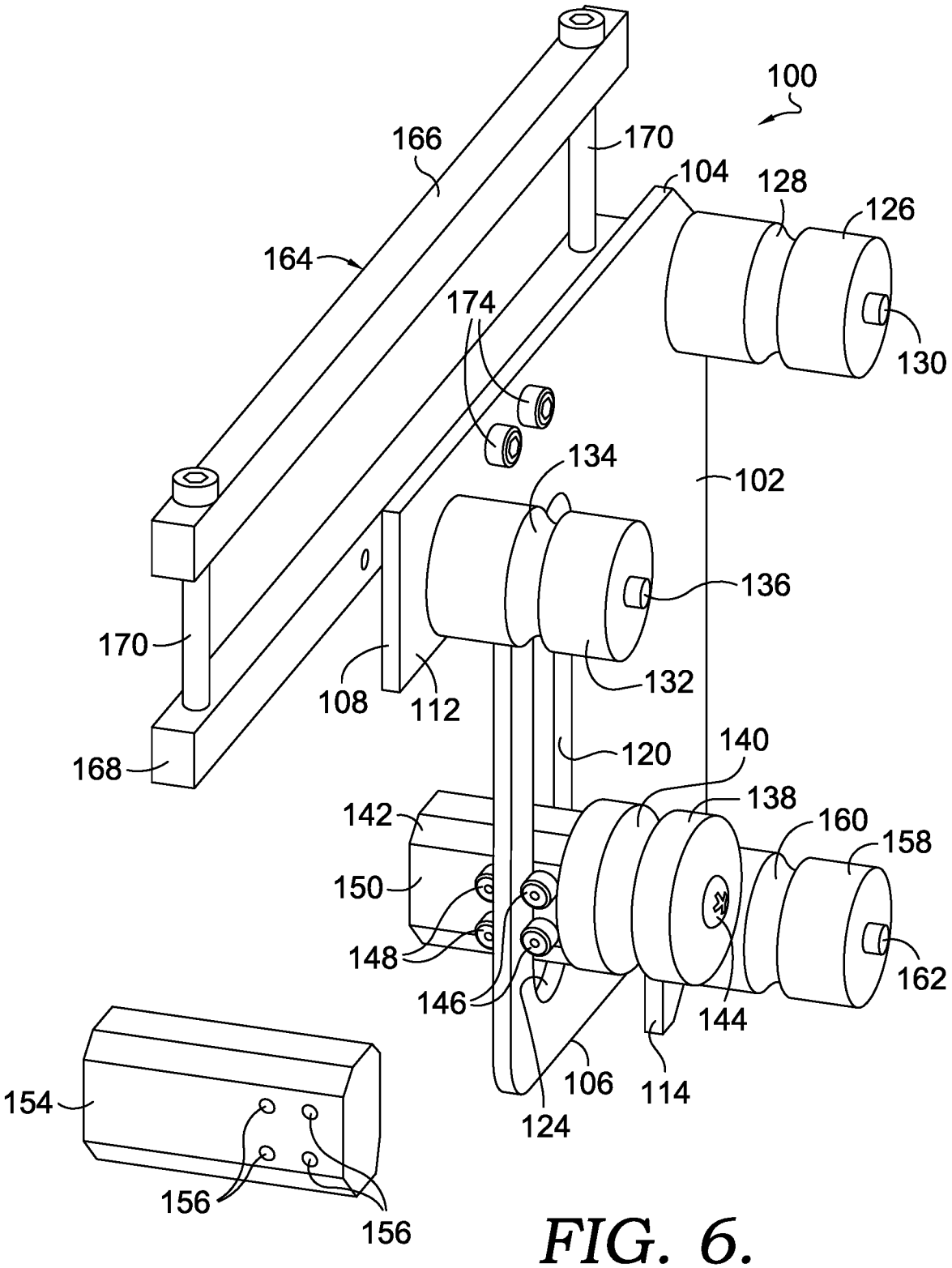
FIG. 6 illustrates a front perspective view of the tensioning device of FIG. 4 in accordance with aspects herein.

FIGS. 4-6 depict perspective views from different angles, of an aspect of the tensioning device 100. The tensioning device 100 includes the mounting plate 102. The mounting plate 102 has an upper end 104 spaced from a lower end 106. Similarly, the mounting plate 102 has a first side 108 spaced from a second side 110. In some aspects, the mounting plate 102 has a generally rectangular main portion and may also have a tab 112 extending along the upper end 104 at the first side 108. In further aspects, the mounting plate 102 may also have a tab 114 extending downwardly from the lower end 106 and along the second side 110. However, it is understood that the mounting plate 102 could have any of a variety of shapes and other shapes are also contemplated herein. Additionally, the mounting plate 102 has a front face 116 and a back face 118. As seen in FIGS. 4 and 5, the mounting plate 102 also has, in some aspects, the slot 120 extending through the mounting plate 102 from the front face 116 to the back face 118. In example aspects, the slot 120 is vertically oriented on the mounting plate 102, with the top end 122 near the upper end 104 of the mounting plate and the bottom end 124 near the lower end 106 of the mounting plate. In some aspects, the amount of tension applied to the yarn (such as strand 216) can be adjusted or limited utilizing a series of stops along slot 120 spaced between the top end 122 and the bottom end 124. Utilizing a stop more toward the top end 122 limits the tension more than utilizing a stop more toward the bottom end 124. In some aspects, a stop that is adjustable along the length of the slot 120 could be used. The stops may be moveable between a first position allowing movement of the third pulley 138 (described below) and a second position preventing movement of the third pulley 138. In other words, stops may be used to effectively shorten the length of the slot 120. The mounting plate 102 may be made from a lightweight, sturdy material, and in some aspects is made from flat metal stock, although other materials could also be used and are contemplated herein.

In example aspects, the tensioning device 100 also includes a number of pulleys coupled to the mounting plate 102. As best seen in FIG. 4, the first pulley 126 is coupled to the mounting plate 102 proximate the upper end 104 and the second side 110. The first pulley 126 may be generally cylindrical and may include a groove 128. The groove 128 may extend around an entire circumference of the first pulley 126 or may extend only partially around the first pulley 126, such as along a top portion of the first pulley 126. In some aspects, the groove 128 is shaped and sized to accommodate the strand 216 utilized on the knitting machine 200. In some aspects, the first pulley 126 is rotatably coupled to the mounting plate 102. This rotatable coupling may be achieved with a pin 130 that extends through a central bore on the first pulley 126 and that is coupled to the mounting plate 102. In some aspects, the pin 130 may be a shoulder bolt that is threaded into the mounting plate 102, although the pin 130 may take other forms to achieve the rotatable coupling.

In example aspects, the second pulley 132 is also coupled to mounting plate 102. The second pulley 132 is coupled to the mounting plate 102 proximate the upper end 104 and the first side 108 of the mounting plate and, in some aspects, the second pulley 132 may be coupled to the tab 112 of the mounting plate 102. In some aspects, the second pulley 132 may be of the same general configuration as the first pulley 126. As shown in FIG. 4, for example, the second pulley 132 has a groove 134 that may be shaped and sized to accommodate the strand 216 utilized on the knitting machine 200. Similar to the first pulley 126, the groove 134 may extend around an entire circumference of the second pulley 132 or may extend only partially around the second pulley 132, such as along a top portion of the second pulley 132. In some aspects, the second pulley 132 is rotatably coupled to the mounting plate 102. This rotatable coupling may be achieved with a pin 136 that extends through a central bore on the second pulley 132 and that is coupled to the mounting plate 102. In some aspects, the pin 136 may be a shoulder bolt that is threaded into the mounting plate 102, although other constructions may be utilized to achieve the rotatable coupling.

As best seen in FIGS. 4 and 6, the tensioning device 100 includes the third pulley 138 that, like the first pulley 126 and the second pulley 132, may include a groove 140. The groove 140 may extend around an entire circumference of the third pulley 138 or may extend only partially around the third pulley 138, such as along a bottom portion of the third pulley 138. The third pulley 138, in some aspects, is coupled to a first bar 142. In some aspects, the third pulley 138 is rotatably coupled to the first bar 142, such as with a pin 144, which may be a shoulder bolt or other construction that allows for rotatable coupling. The first bar 142 extends through the slot 120 on the mounting plate 102 such that the combination of the first bar 142 and the third pulley 138 are vertically movable within the slot 120 with respect to the mounting plate 102. One or more first bearings 146 may be coupled to the first bar 142 and positioned to engage the front face 116 of the mounting plate 102. Similarly, one or more second bearings 148 may be coupled to the first bar 142 and positioned to also engage the back face 118 of the mounting plate 102. In some aspects, the back face 118 may include a recessed area 149 (as shown in FIG. 5) to further guide the second bearings 148. As shown in FIGS. 5 and 6, the first bearings 146 and the second bearings 148 may be coupled to a first side 150 of the first bar 142, a second side 152 of the first bar 142, or both the first side 150 and the second side 152 of the first bar 142.

As shown in FIG. 6, the tensioning device 100 can also include a second bar 154. In some aspects, the second bar 154 has a weight that is different than the first bar 142. For example, the second bar 154 may be made from a different material than the first bar 142 or, in other examples, the second bar 154 may be made from the same material as the first bar 142 but may be larger. As shown in FIG. 6, the second bar 154 includes mounting holes 156. The mounting holes 156 may be threaded, allowing the first bearings 146 and the second bearings 148 to be removed from the first bar 142 and, in turn, coupled to the second bar 154. In this manner, the first bar 142 can be interchanged with the second bar 154 (and vice versa) so that the weight coupled to the third pulley 138 can be varied as desired. Any other number of bars of differing weights may be utilized in a similar manner such that the bars can be interchanged with the first bar 142 to adjust the weight coupled to the third pulley 138 as desired to adjust tension on the strand 216.

As shown in FIG. 6, in some aspects, the fourth pulley 158 is also coupled to the mounting plate 102 proximate the lower end 106 and the second side 110. The fourth pulley 158 may be selectively used to increase tension and/or friction on the strand 216 as it moves through the tensioning device 100. For example, the fourth pulley 158 can be coupled to the tab 114 of the mounting plate 102. In some aspects, the fourth pulley 158 can be of the same general configuration as the first pulley 126. For example, as shown, the fourth pulley 158 can have a groove 160 that is shaped and sized to accommodate the strand 216 utilized on a knitting machine 200. The groove 160 may extend around an entire circumference of the fourth pulley 158 or only partially around the fourth pulley 158, such as along a bottom portion and side portion of the fourth pulley 158. In some aspects, the fourth pulley 158 is rotatably coupled to the mounting plate 102. This rotatable coupling may be achieved with a pin 162 that extends through a central bore on the fourth pulley 158 and that is coupled to the mounting plate 102. In some aspects, the pin 162 is a shoulder bolt that is threaded into the mounting plate 102, although other constructions may be utilized to achieve the rotatable coupling. In some aspects, the fourth pulley 158 is generally movable with respect to the mounting plate 102, such as within a vertical slot or an arcuate slot. In other aspects, the fourth pulley 158 may be coupled to a biasing member, such as a spring, to actively bias the fourth pulley 158 within a slot on the mounting plate 102 to add additional friction and/or tension to a strand. Any of the pulleys described above (first pulley 126, second pulley 132, third pulley 138, and fourth pulley 158) may be exchanged to accommodate different types of yarn, with the corresponding grooves (groove 128, groove 132, groove 140, and groove 160) sized to accommodate the yarn in use. As set forth above, the range of motion of the any of the pulleys could also be altered to adjust the tension (such as, for example, limiting the range of motion of third pulley 138 and/or fourth pulley 158). Additionally, the weight of any of the pulleys (first pulley 126, second pulley 132, third pulley 138, and fourth pulley 158), or the arms (such as first bar 142 and/or the second bar 154) could be changed to adjust the tension on the yarn. In some aspects, the tensioning device 100 could be exchanged when different sizes and/or weights of yarn are used.

As shown in FIG. 6, in some aspects, the tensioning device 100 may also include a mounting arm 164. The mounting arm 164 couples the tensioning device 100 to the knitting machine 200, as discussed above with reference to FIGS. 1-3. The mounting arm 164 includes the upper member 166 spaced from the lower member 168. The upper member 166 and the lower member 168 are coupled together with connectors 170 (e.g., screws, bolts, shoulder bolts or the like). As best seen in FIG. 5, the lower member 168 includes a series of mounting holes 172. The mounting holes 172 are threaded to accommodate bolts 174 (as seen in FIGS. 4 and 6) that may be inserted through corresponding holes in the mounting plate 102 and threaded into the mounting holes 172.

Figure 7:
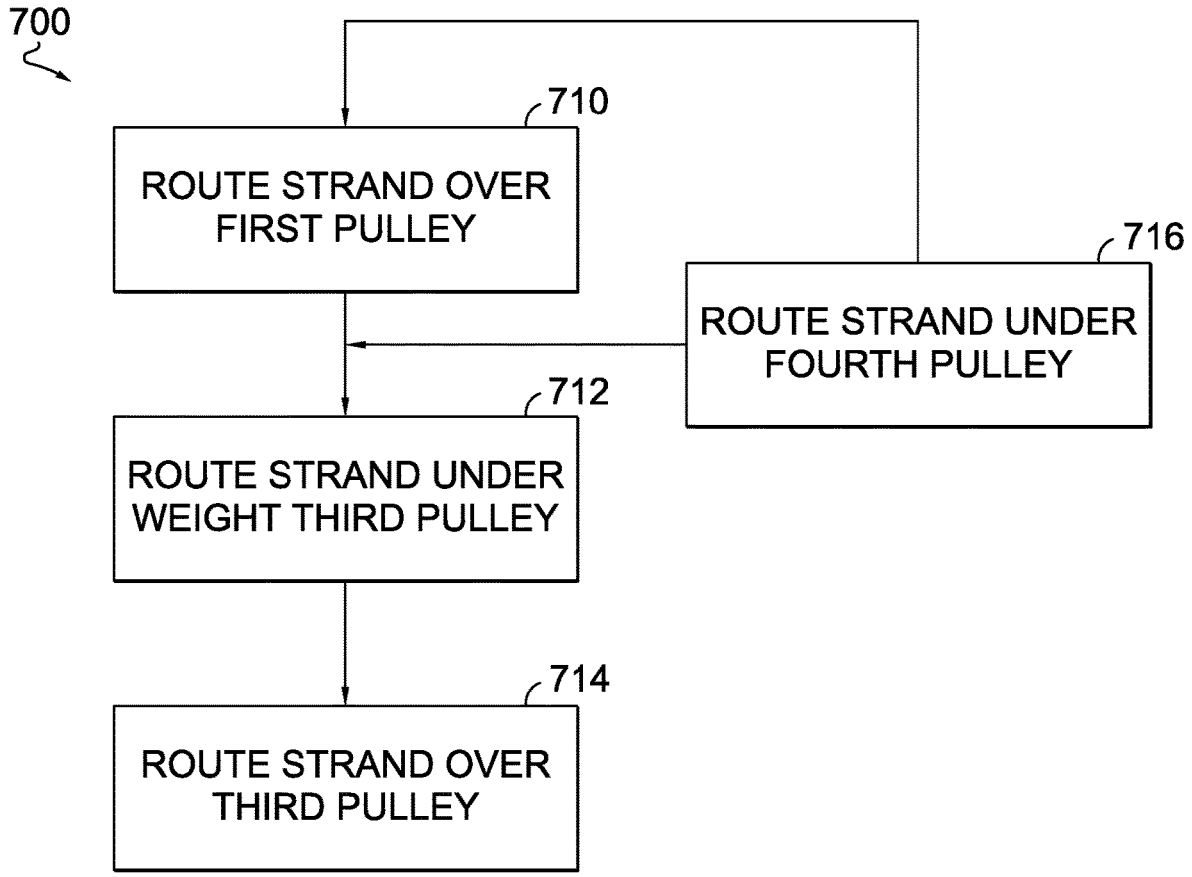
FIG. 7 illustrates a flow diagram of an example method of providing side tension to a strand on a knitting machine, in accordance with aspects herein.

FIG. 7 depicts a flow diagram of an example method 700 of providing side tension to a strand being knitted or inlaid into a garment by a knitting machine, such as the knitting machine 200. Method 700 may be performed through the use of a tensioning device, such as tensioning device 100. At step 710, the method 700 includes routing a strand over a first pulley, which may have similar features as the first pulley 126 previously described. At step 712, the method 700 includes routing the strand under a weighted third pulley, which may have similar features as the third pulley 138 previously described, and then, at step 714, routing the strand over a second pulley, which may have similar features as the second pulley 132 previously described. At step 712, in some aspects, the weighted third pulley is located below the first pulley and the second pulley, and the third pulley is arranged to allow for vertical movement. The weight of the third pulley adds tension to the strand when the knitting machine is not otherwise actively feeding the strand through the knitting machine (such as when the feeder changes directions at the turn-around), thus increasing the tension on the strand and removing at least some of the slack in the strand that may be present. In some aspects, as shown at step 716, the strand may be routed around a fourth pulley (which may have similar features as the fourth pulley 158 previously described, after the first pulley and before the third pulley. In some aspects, the fourth pulley is arranged to move to adjust the tension or friction imparted on the strand as it moves through the knitting machine.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1. A tensioning device for at least one strand, a portion of the at least one strand extending between a feeder bar and a strand source on a knitting machine, the tensioning device comprising: a mounting plate having an upper end and a lower end, a first side and a second side spaced farther from the feeder bar than the first side; a first pulley coupled to the mounting plate; a second pulley coupled to the mounting plate and spaced from the first pulley; and a third pulley having a first weight, the third pulley movably coupled to the mounting plate between the first pulley and the second pulley, and positioned at least partially below the first pulley and the second pulley, wherein the movable coupling of the third pulley to the mounting plate allows a movement of the third pulley in a direction between the upper end of the mounting plate and the lower end of the mounting plate, wherein the at least one strand is routable over the first pulley, under the third pulley and over the second pulley, wherein the first weight of the third pulley provides a downward force to increase tension on the at least one strand.

Clause 2. The tensioning device of clause 1, wherein the first pulley is coupled to the mounting plate proximate the upper end of the mounting plate and proximate the second side of the mounting plate.

Clause 3. The tensioning device of any of clauses 1-2, wherein the second pulley is coupled to the mounting plate proximate the upper end of the mounting plate and proximate the first side of the mounting plate.

Clause 4. The tensioning device of any of clauses 1-3, wherein the mounting plate includes a vertical slot having a bottom end proximate the lower end of the mounting plate and extending to a top end spaced from the bottom end; the tensioning device further comprising a first bar extending through the vertical slot on the mounting plate, the first bar having a second weight, wherein the third pulley is coupled to the first bar, and wherein the first bar and the third pulley are vertically moveable with respect to the mounting plate within the vertical slot, wherein the first weight of the third pulley and the second weight of the first bar provide a downward force to increase tension on the at least one strand.

Clause 5. The tensioning device of any of clauses 1-4, further comprising a series of stops extending along the slot between the bottom end of the slot and the top end of the slot, the stops movable between a first position allowing movement of the third pulley along the slot and a second position preventing movement of the third pulley along the slot, wherein, in the first position, the stops effectively shorten the length of the slot.

Clause 6. The tensioning device of any of clauses 1-5, further comprising a stop positionable along the slot between the bottom end of the slot and the top end of the slot, the stop movable between a first position allowing movement of the third pulley along the slot and a second position preventing movement of the third pulley along the slot, wherein, in the first position, the stop effectively shortens the length of the slot.

Clause 7. The tensioning device of any of clauses 1-6, wherein the first pulley and the second pulley are both rotatably coupled to the mounting plate, and wherein the third pulley is rotatably coupled to the first bar.

Clause 8. The tensioning device of any of clauses 1-7, wherein the mounting plate has a front face and a back face, the tensioning device further comprising at least a first bearing coupled to the first bar and abutting the front face and at least a second bearing coupled to the first bar and abutting the back face, wherein at least the first bearing and the second bearing provide controlled movement of the first bar within the vertical slot on the mounting plate.

Clause 9. The tensioning device of any of clauses 1-8, wherein the first bar is removably coupled to the third pulley, the tensioning device further comprising a second bar, having a third weight different from the second weight of the first bar, and interchangeable with the first bar to allow the tension on the at least one strand to be selectively changed.

Clause 10. The tensioning device of any of clauses 1-9, further comprising a mounting arm, coupled to the upper end of the mounting plate, the mounting arm facilitating coupling the tensioning device to a rail on the knitting machine.

Clause 11. The tensioning device of any of clauses 1-10, further comprising a fourth pulley coupled to the mounting plate, below the first pulley and proximate the second side of the mounting plate, wherein the at least one strand is routable over the first pulley, around the fourth pulley, under the third pulley and over the second pulley.

Clause 12. The tensioning device of any of clauses 1-12, wherein any of the first pulley, the second pulley, the third pulley and the fourth pulley have a groove, and wherein the width of the groove may be selected based upon a diameter of the strand.

Clause 13. The tensioning device of any of clauses 1-12, wherein the fourth pulley is adjustably coupled to the mounting plate such that the position of the fourth pulley with respect to the mounting plate is adjustable.

Clause 14. A knitting machine, comprising: a strand source; a feeder bar; at least one strand extending from the strand source and through the feeder bar; and a tensioning device for the at least one strand, located between the strand source and the feeder bar, the tensioning device comprising: a mounting plate having an upper end, a lower end, a first side, and a second side spaced farther from the feeder bar than the first side; a first pulley coupled to the mounting plate; a second pulley coupled to the mounting plate and spaced from the first pulley; and a third pulley, having a weight, the third pulley movably coupled to the mounting plate between the first pulley and the second pulley, and positioned at least partially below the first pulley and the second pulley, wherein the movable coupling of the third pulley to the mounting plate allows a movement of the third pulley in a direction between the upper end of the mounting plate and the lower end of the mounting plate, wherein the weight of the third pulley provides a tension to the at least one strand to reduce slack from the at least one strand.

Clause 15. The knitting machine of clause 14, wherein the first pulley is coupled to the mounting plate proximate the upper end of the mounting plate and proximate the second side of the mounting plate, and wherein the second pulley is coupled to the mounting plate proximate the upper end of the mounting plate and proximate the first side of the mounting plate, and wherein the at least one strand is routable over the first pulley, under the third pulley and over the second pulley.

Clause 16. The knitting machine of any of clauses 14-15, wherein the mounting plate includes a vertical slot having a bottom end proximate the lower end of the mounting plate and extending to a top end spaced from the bottom end; the tensioning device further comprising a bar extending through the vertical slot on the mounting plate, wherein the third pulley is coupled to the bar, and wherein the bar and the third pulley are vertically moveable with respect to the mounting plate within the vertical slot.

Clause 17. The knitting machine of any of clauses 14-16, wherein the mounting plate has a front face and a back face, the tensioning device further comprising at least a first bearing coupled to the bar and abutting the front face and at least a second bearing coupled to the bar and abutting the back face, wherein at least the first bearing and the second bearing provide controlled movement of the bar within the vertical slot on the mounting plate.

Clause 18. The knitting machine of any of clauses 14-17, further comprising a mounting arm, coupled to the upper end of the mounting plate, the mounting arm facilitating coupling of the tensioning device to a rail on the knitting machine.

Clause 19. A method for providing side tension to at least one strand on a knitting machine, the method comprising: routing the at least one strand over a first pulley; routing the at least one strand under a weighted third pulley that is vertically movable with respect to the first pulley; and routing the at least one strand over a second pulley.

Clause 20. The method of clause 19, further comprising adding an additional weight to the weighted third pulley to increase a tension on the at least one strand.

Clause 21. The method of any of clauses 19-20, wherein the additional weight added to the weighted third pulley is based on at least one of the weight of the at least one strand or the diameter of the at least one strand.

Clause 22. The method of any of clauses 19-21, further comprising, after routing the at least one strand over the first pulley, routing the at least one strand around a fourth pulley before routing the at least one strand under the weighted third pulley.

Clause 23. The method of any of clauses 19-22, further comprising adjusting the spacing between the first pulley and the fourth pulley to provide additional tension to the at least one strand.

Clause 24. The method of any of clauses 19-23, further comprising limiting the distance the third pulley is vertically movable to adjust the tension added to the strand.

Clause 25. The method of any of clauses 19-24, wherein the amount of side tension added to the strand is based on one or more of the weight of the third pulley, the weight of the added weight, or the length of vertical movement allowed of the third pulley.

Clause 26. The method of any of clauses 19-24, wherein the amount of side tension added to the strand is based on one or more of the groove size in one or more of the pulleys, the range of motion of one or more of the pulleys, the weight of one or more of the pulleys, the weight of the additional weight, and the number of pulleys over which the strand is routed.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A tensioning device for at least one strand, a portion of the at least one strand extending between a feeder bar and a strand source on a knitting machine, the tensioning device comprising:

a mounting plate having an upper end and a lower end, a first side and a second side spaced farther from the feeder bar than the first side, wherein the mounting plate comprises a slot;

a first pulley coupled to the mounting plate;

a second pulley coupled to the mounting plate and spaced from the first pulley; and a third pulley having a first weight, the third pulley movably coupled to the mounting plate between the first pulley and the second pulley, and positioned at least partially below the first pulley and the second pulley, wherein the movable coupling of the third pulley to the mounting plate allows a movement of the third pulley in a direction between the upper end of the mounting plate and the lower end of the mounting plate, wherein the at least one strand is routable over the first pulley, under the third pulley and over the second pulley, wherein the first weight of the third pulley provides a downward force to increase tension on the at least one strand;

wherein the third pulley is coupled to a bar that is moveable between a plurality of fixed positions within the slot; and wherein the bar is a first bar, wherein the first bar is removably coupled to the third pulley, the tensioning device further comprising a second bar having a third weight different from a second weight of the first bar, and interchangeable with the first bar to allow the tension on the at least one strand to be selectively changed.

2. The tensioning device of claim 1, wherein the first pulley is coupled to the mounting plate proximate the upper end of the mounting plate and proximate the second side of the mounting plate.

3. The tensioning device of claim 1, wherein the second pulley is coupled to the mounting plate proximate the upper end of the mounting plate and proximate the first side of the mounting plate.

4. The tensioning device of claim 1, wherein the slot is aligned vertically by having a bottom end proximate the lower end of the mounting plate and extending to a top end spaced from the bottom end.

5. The tensioning device of claim 1, further comprising a series of stops extending along the slot between a bottom end of the slot and a top end of the slot, wherein each of the series of stops is movable between a first position allowing movement of the third pulley along the slot and a second position preventing movement of the third pulley along the slot.

6. The tensioning device of claim 1, further comprising a stop positionable along the slot between a bottom end of the slot and a top end of the slot, the stop movable between a first position allowing movement of the third pulley along the slot and a second position preventing movement of the third pulley along the slot, wherein, in the first position, the stop shortens a length of the slot.

7. The tensioning device of claim 1, wherein the first pulley and the second pulley are both rotatably coupled to the mounting plate, and wherein the third pulley is rotatably coupled to the bar.

8. The tensioning device of claim 1, wherein the mounting plate has a front face and a back face, the tensioning device further comprising at least one first bearing coupled to the bar and abutting the front face and at least one second bearing coupled to the bar and abutting the back face, wherein the at least one first bearing and the at least one second bearing provide controlled movement of the bar within the slot in the mounting plate.

9. The tensioning device of claim 1, further comprising a mounting arm, coupled to the upper end of the mounting plate, the mounting arm facilitating coupling the tensioning device to a rail on the knitting machine.

10. The tensioning device of claim 1, further comprising a fourth pulley coupled to the mounting plate, below the first pulley and proximate the second side of the mounting plate, wherein the at least one strand is routable over the first pulley, around the fourth pulley, under the third pulley and over the second pulley.

11. The tensioning device of claim 10, wherein at least one of the first pulley, the second pulley, the third pulley, and the fourth pulley comprise a groove, and wherein a width of the groove may be selected based upon a diameter of the strand.

12. The tensioning device of claim 10, wherein the fourth pulley is adjustably coupled to the mounting plate such that a position of the fourth pulley with respect to the mounting plate is adjustable.

* * * * *